US006230377B1

(12) United States Patent
Tanno

(10) Patent No.: US 6,230,377 B1
(45) Date of Patent: May 15, 2001

(54) METHOD AND DEVICE FOR SEPARATING STRANDS

(75) Inventor: Daniel Tanno, Chur (CH)

(73) Assignee: Stäubli AG Pfäffikon, Pfäffikon (CH)

( * ) Notice: Subject to any disclaimer, the term of this patent is extended or adjusted under 35 U.S.C. 154(b) by 0 days.

(21) Appl. No.: 09/509,189

(22) PCT Filed: Sep. 18, 1998

(86) PCT No.: PCT/CH98/00400

§ 371 Date: Jun. 19, 2000

§ 102(e) Date: Jun. 19, 2000

(87) PCT Pub. No.: WO99/15723

PCT Pub. Date: Apr. 1, 1999

(30) Foreign Application Priority Data

Sep. 23, 1997 (CH) ..... 2238/97

(51) Int. Cl.[7] ..... D03J 1/14
(52) U.S. Cl. ..... 28/205; 28/208
(58) Field of Search ..... 28/205, 208

(56) References Cited

U.S. PATENT DOCUMENTS 3,744,109 * 7/1973 Dohi et al. .
4,499,638 * 2/1985 John .
4,520,539 * 6/1985 John .
5,153,972 * 10/1992 Fabrizio .
5,184,380 * 2/1993 Benz et al. .
5,475,906 * 12/1995 Magdika .

FOREIGN PATENT DOCUMENTS 21 24 017 12/1971 (DE) .
0 478 513 4/1991 (EP) .
0 448 957 10/1991 (EP) .
0 646 668 4/1995 (EP) .
2 514 039 4/1983 (FR) .
2 109 426 6/1983 (GB) .

* cited by examiner

*Primary Examiner*—John J. Calvert
*Assistant Examiner*—Robert H. Muromoto, Jr.
(74) *Attorney, Agent, or Firm*—Venable; Gabor J. Kelemen

(57) ABSTRACT

The invention relates to a method and an apparatus for singularizing healds, which are lined up via eyes on supporting rails to form a stack. In a method and an apparatus which carefully handle the healds during the separation and subsequent transport away from the stack and stress them as little as possible, especially by friction, the frontmost heald (15, 16) in the stack is laterally deflected in one region (11) of the heald and removed from the stack. The frontmost heald is then removed from the stack in further regions in a direction pointing away from the stack and is finally transported further away from the stack in the region of its eyes (7) along the supporting rails by transport members (12, 13).

15 Claims, 5 Drawing Sheets

Figure 1:
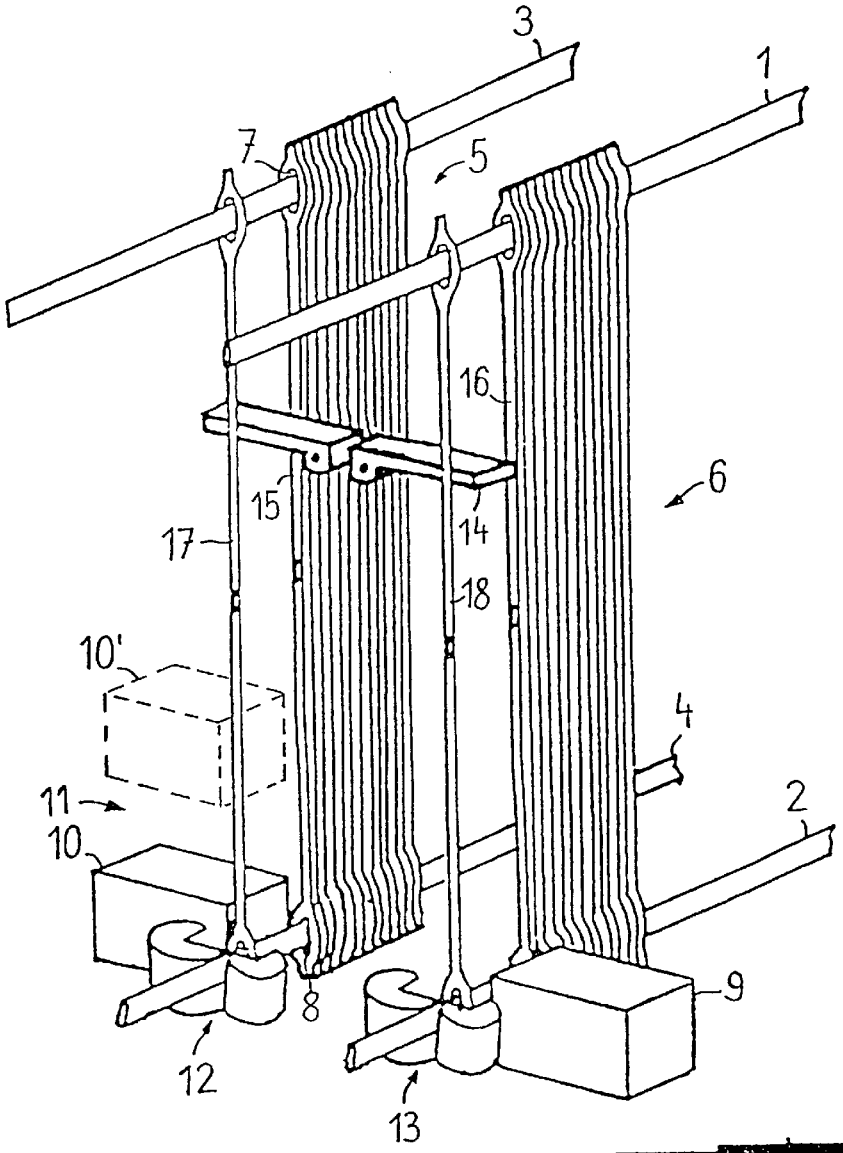

Fig.4
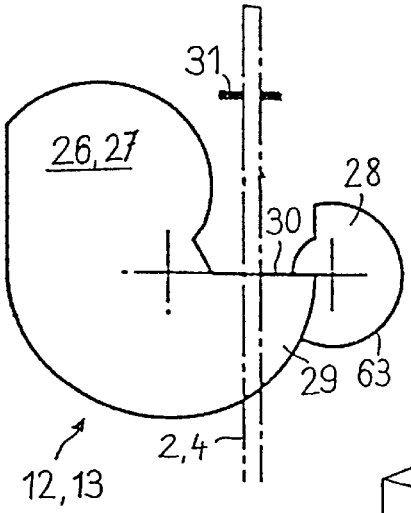
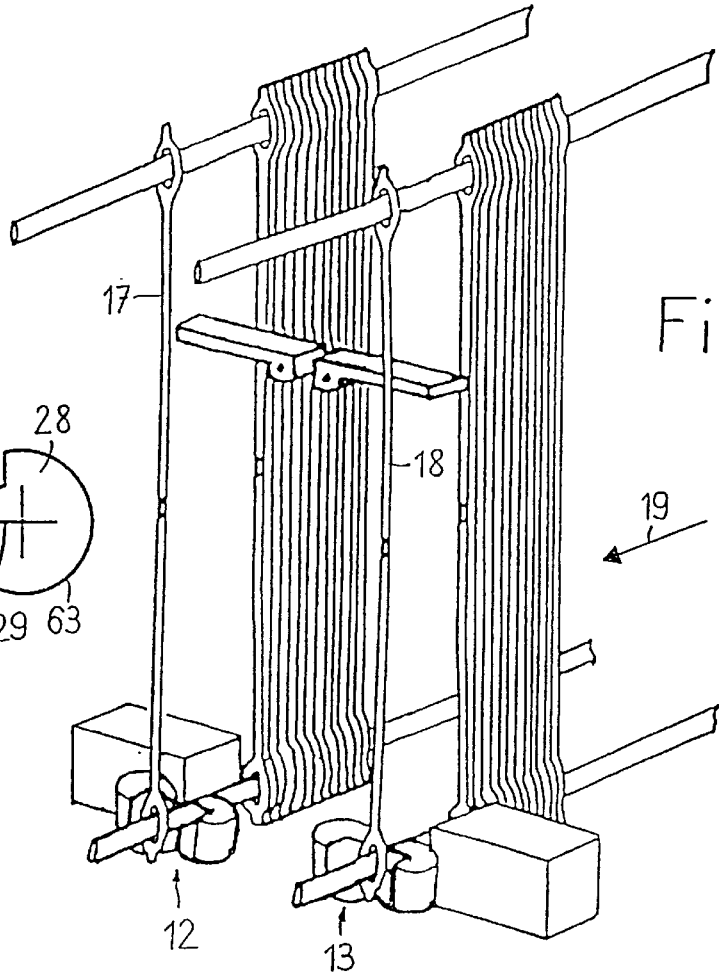
Fig.2
Fig.5
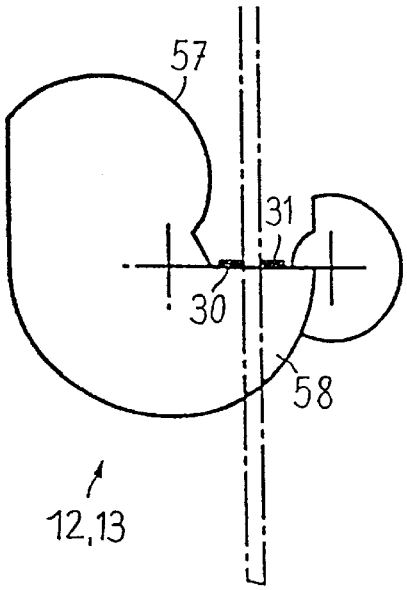
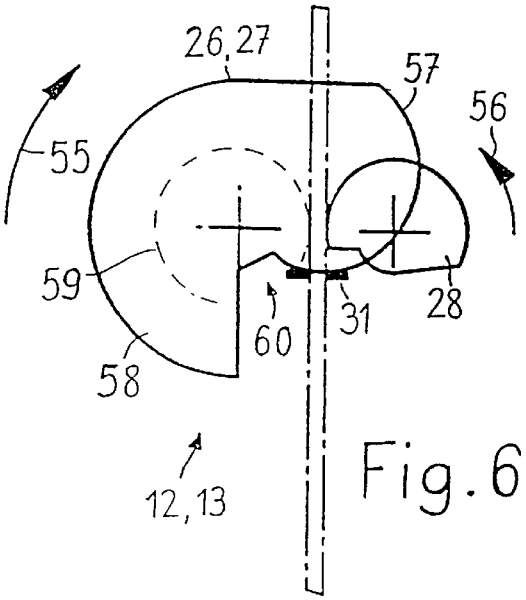
Fig.6

METHOD AND DEVICE FOR SEPARATING STRANDS

The invention relates to a method and an apparatus for singularizing healds, which are lined up at eyes on supporting rails to form a stack.

EP 0 448 957 discloses an apparatus of the aforesaid type in which the healds suspended on supporting rails are laterally deflected in one region from a plane formed by the supporting rails and are elastically deformed in the process. Then, this laterally deflected region, in a direction inclined relative to said plane, is moved along a path away from the stack until this path penetrates into said plane and the lateral deformation of the heald is neutralized again. Since, due to the movement of the region along said path, the heald is also partly deflected from its own plane, which is defined, for example, by the eyes, further regions of the heald follow in a delayed manner. For example, the eyes on the supporting rails move away from the stack later than the laterally deflected region. In the event that parts of the heald stick to the adjacent heald in the stack and therefore do not move away from the stack in the desired manner, a blade-like pivoted lever is provided, and this pivoted lever moves in a plane parallel to that of the heald in the stack and releases such parts from the stack. For each stack, two separating devices are provided at the top and bottom and a pivoted lever is provided in between.

EP 0 646 668 A1 discloses an apparatus of basically the same construction. This apparatus can be used for carrying out a singularizing method in which the frontmost heald of a stack in each case is separated and moved to a transporting unit, for example an endless belt provided with receiving pins for the healds. For singularizing the healds from a stack, firstly the respectively frontmost heald is deflected. Subsequently, the heald is moved in the transporting direction over the entire transporting path to the endless belt by one or more transporting means in the region between the two eyes of the heald pressing against the latter in a directon running obliquely—with respect to a [lacuna] with respect to the supporting rails.

These known apparatuses are unable to give complete satisfaction, since, on the one hand, the stack—as viewed in the direction of the supporting rails—rests on the separating device, so that the healds can be worn out or damaged by the movement of the separating device. On the other hand, the healds, for the transport along the supporting rails, are seized or driven more or less away from the supporting rails, so that the eyes on the supporting rails may tilt and the friction between supporting rail and eye increases.

The object of the invention, then, as characterized in the patent claims, is to provide a method and an apparatus which carefully handle the healds during the separation and subsequent transport away from the stack and stress them as little as possible, especially by friction.

This can be achieved in that the frontmost heald in the stack is laterally deflected in one region of the heald and is then removed from the stack over a first distance. The frontmost heald is then also removed from the stack in further regions in a direction pointing away from the stack, and finally the heald is driven in the region of its eyes and transported further away from the stack along the supporting rails by a second distance. While the heald is laterally deflected, the stack is pushed back.

The apparatus according to the invention may therefore have a separating member designed as a separating blade and intended for separating the frontmost heald from the stack, a stack pusher for pushing back the stack, and a separating finger for separating the heald from the stack over a large part of the length of the heald. Furthermore, it may have a transport member which is arranged in the region of the eyes of the healds. In this case, it is preferred if the transport member is also designed for supporting the supporting rails against the force of gravity.

The advantages achieved by the invention may be seen, in particular, in the fact that all heald types are reliably separated without being damaged or scratched. This is achieved owing to the fact that the heald does not perform any movement relative to the separating blade during the separation. The drive of the separating blade and of the stack pusher can be controlled by detents in such a way that only a single common drive for both elements may be provided, which ensures corresponding cost savings as well as a less—complicated apparatus. Since as little friction as possible occurs between the healds and the separating device, the wear remains low, even when considered over a longer period. In addition, the apparatus according to the invention is also suitable for being designed as at least a twin apparatus for at least two stacks. In this case, various movements may take place in a coordinated manner and consequently common drives may also be provided.

Preferred embodiments of the invention are described in the claims.

Figure 3:
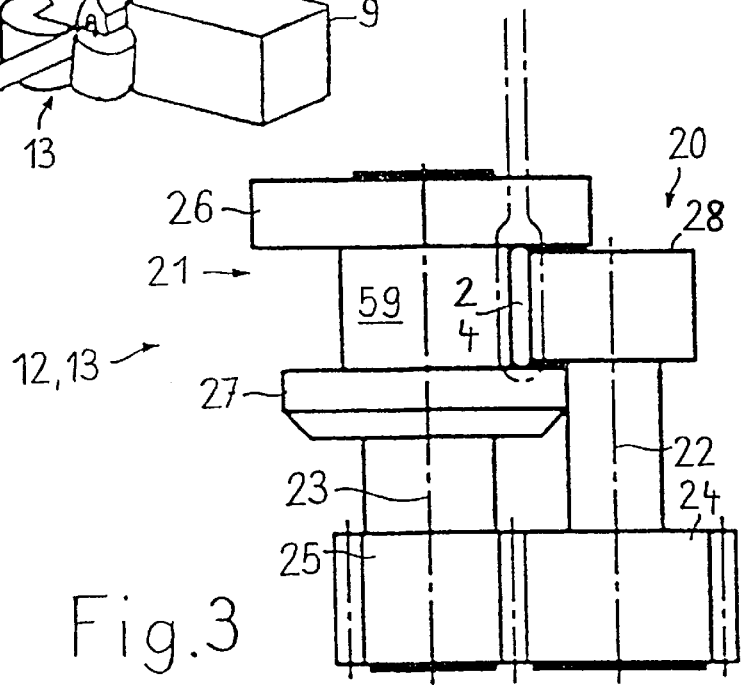
Figure 10:
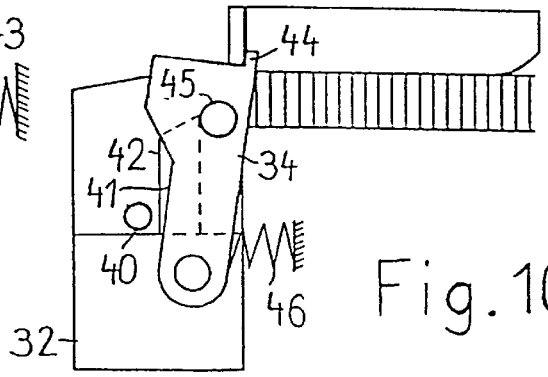
Figure 11:
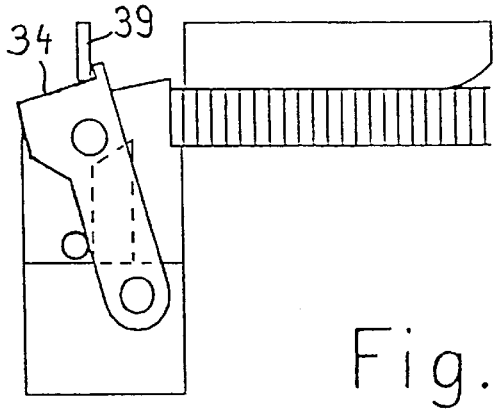
Figure 12:
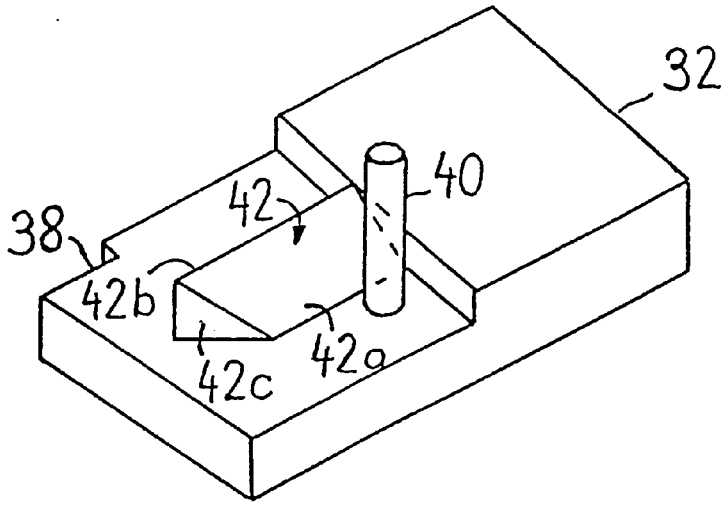
Figure 13:
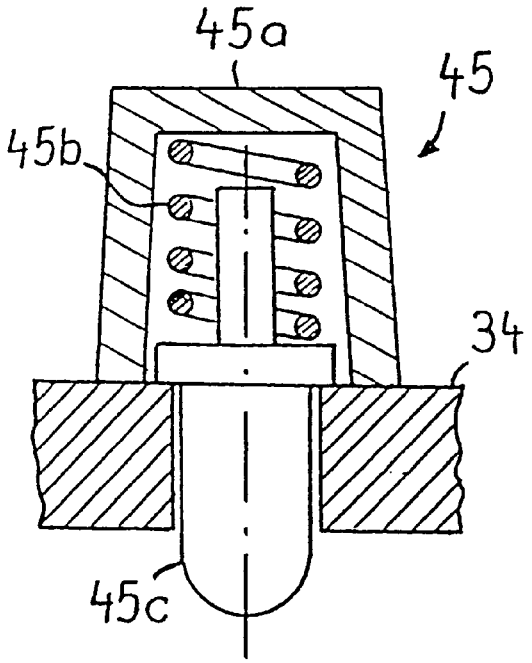
Figure 16:
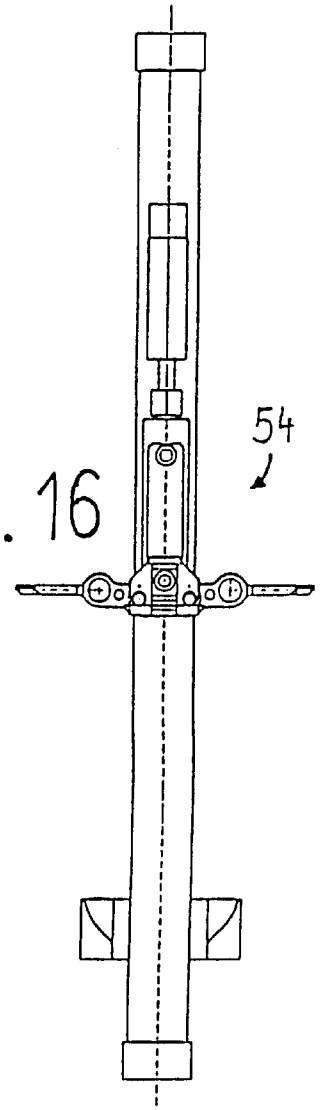
Figure 15:
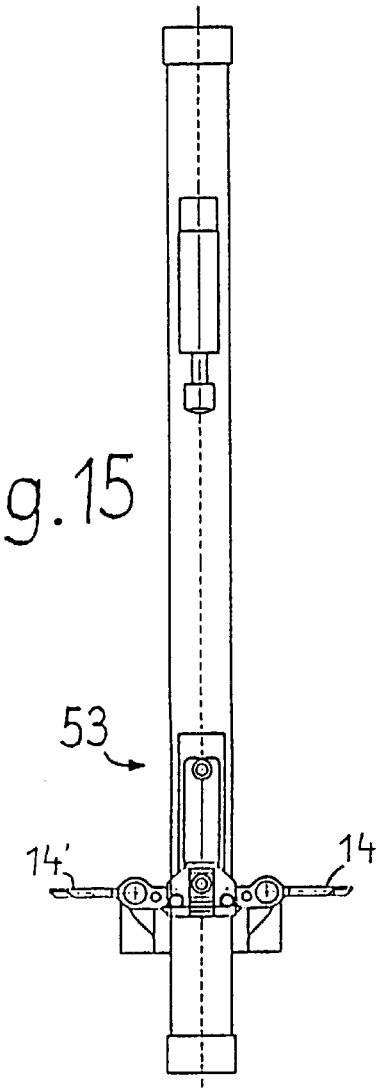
Figure 14:
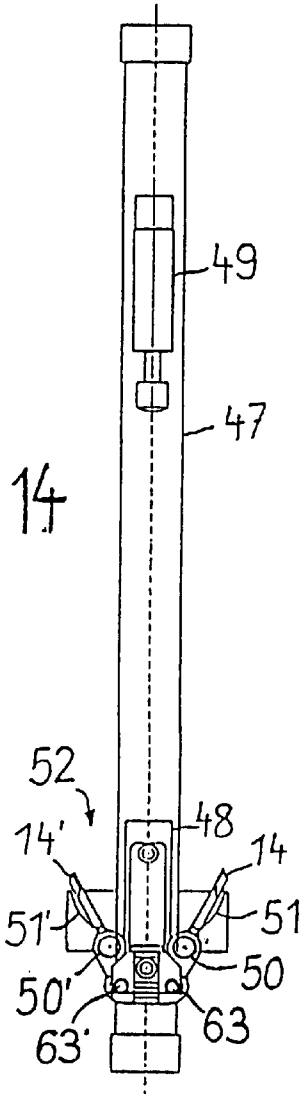

The invention is explained in more detail below with the aid of an example and with reference to the attached figures. In the drawing:

FIGS. 1 and 2 each show a perspective and simplified representation of the apparatus according to the invention, FIG. 3 shows a view of a part of the apparatus, FIGS. 4, 5 and 6 each show a schematic representation of various positions of the part according to FIG. 3, FIGS. 7, 8, 9, 10, 11 each show a schematic representation of various positions of a further part of the apparatus, FIGS. 12 and 13 each show a part of the apparatus, and FIGS. 14, 15 and 16 each show a further part of the apparatus in various positions.

FIG. 1 shows a part of an apparatus for drawing warps into healds and in particular that part which separates the healds from a stack. Two stacks 5, 6 of healds are lined up with their top and bottom eyelets 7, 8 next to one another and essentially vertically on two supporting rails 1, 2, 3, 4 each. A separating device 9, 10 is assigned to each stack 5, 6 in a region 11 along the healds in the vicinity of the bottom eyes 8. In FIG. 1, this region, by way of example, is indicated by the position of the separating device 10 and the separating device 10', which simply marks another possible position for the separating device 10. It will also be seen that a transport member 12, 13 is arranged for each stack 5, 6 in the region of the eyes 8. Such transport members are assigned to each supporting rail 1, 2, 3, 4—and thus also to the top eyes 7. Since the construction of the individual transport members can preferably always be identical, only the transport members 12, 13 of the bottom supporting rails 2, 4 are shown in FIG. 1. A twin separating finger 14 is also provided here in front of the stack 5, 6 and in FIG. 1 is located between the frontmost heald 15, 16 and the already separated heald 17, 18.

FIG. 2 shows the same elements as FIG. 1. One difference, however, is that the already separated healds 17, 18 are located behind the transport member 12, 13 in the direction of transport or movement of the healds. The direction of transport or movement of the healds is indicated in this figure by an arrow 19, which runs parallel to the longitudinal extent of the supporting rails.

A transport member 12, 13 is shown enlarged in FIG. 3, this representation being viewed in the opposite direction to the direction of the arrow 19 and in the direction of one of the two supporting rails 2, 4. The transport member 12, 13 has two rotary bodies 20, 21, which are mounted in a fixed position about one rotation axis 22, 23 each. The rotary bodies 20, 21 are each provided with a gear 24, 25, and these gears 24, 25 mesh with one another. The rotary body 21 has supporting bodies 26, 27 arranged above and below the supporting rail 2, 4, whereas the rotary body 20 is provided with a driver 28, which is located next to the supporting rail 2, 4.

FIG. 4 shows a transport member 12, 13 from above in a first position. The supporting bodies 26, 27 guide the supporting rail 2, 4 via a lug 29 and form with a surface 30 a stop for a separated heald 31. The driver 28 opens a passage for the heald 31.

FIG. 5 shows the transport member 12, 13 according to FIG. 4 in the same position, but with the heald 31 in an intermediate position on the stop at the surface 30 in front of the transport member 12, 13.

FIG. 6 shows the transport member 12, 13 according to FIG. 4 in a further position, in which the driver 28 and the supporting bodies 26, 27 are rotated by 90°. The heald 31 is arranged in a further position—relative to its transport direction—behind the transport member 12, 13.

Figure 7:
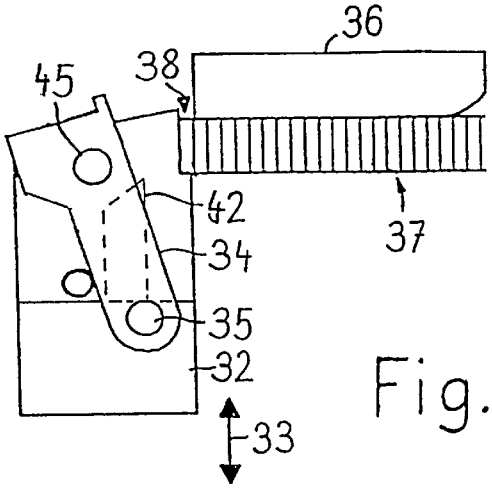

FIG. 7 schematically shows the most important parts of the separating device 9, 10, namely the separating blade 32, which is movably mounted and also driven in the direction of the arrow 33, and the stack pusher 34, which is rotatably mounted on a fixed pivot 35. A guide 36 for a stack 37, a spring-loaded control pin 45, and a detent 42 can also be seen. The position shown is the initial or rest position, in which the stack rests in a recess 38 at the separating blade 32.

Figure 8:
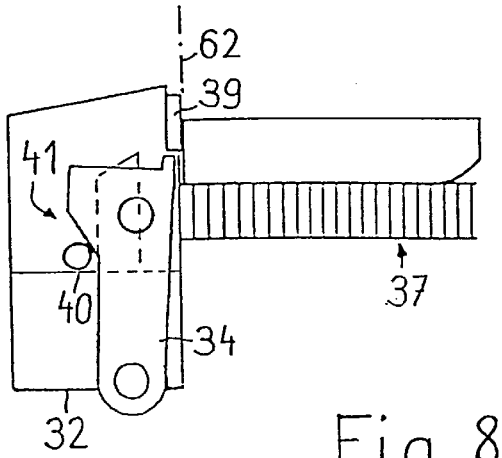

FIG. 8 shows a further position with partly extended separating blade 32, and a frontmost heald 39 of the stack 37, which heald 39 is deflected into or parallel to a plane 62 by the recess 38. A stud 40 arranged in a fixed position on the separating blade 32 is located on a detent 41 on the stack pusher 34.

Figure 9:
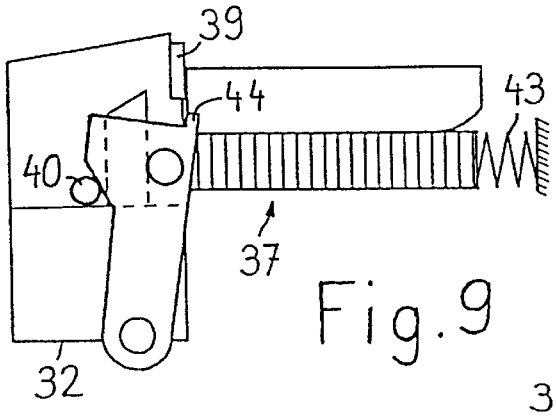

FIG. 9 shows a further position with separating blade 32 extended further, the stud 40 having advanced further on the detent 41 and the stack 37 being pushed back in the process by a few millimeters against the force of a spring 43. As a result, a lug 44 of the stack pusher 34 is now located between the stack 37 and the partly separated heald 39.

FIG. 10 shows a further position in which the separating blade 32 is already on the way back and the stack pusher 34 is retained in position by the detent 42 via the extended control pin 45. The detent 41 no longer bears against the stud 40.

FIG. 11 shows an end position with swung-back stack pusher 34 and the heald 39 put into an intermediate position (also see FIG. 5).

FIG. 12 shows the separating blade 32 in perspective representation (again enlarged). The separating blade 32 has, in particular, the stud 40, the recess 38 for the healds, and the detent 42. The detent 42 is provided with an inclined contact surface 42*a*, a side surface 42*b* essentially perpendicular to the separating blade, and an end surface 42*c*.

FIG. 13 shows a section through the control pin 45, which is fastened to the stack pusher 34 in such a way that it can interact with the detent 42 on the separating blade 32. The control pin 45 essentially comprises a cup 45*a*, a spring 45*b* arranged in the cup 45*a*, and a pin 45*c*.

FIG. 14 shows a drive for a separating finger 14, 14', having a rodless pneumatic cylinder 47, a slide 48 for the separating fingers 14, 14', and a shock absorber 49. The separating fingers 14, 14' are rotatably mounted about axes 63, 63' on the slide 48. Rollers 50, 50' are in turn mounted on the separating fingers 14, 14' and bear against a fixed detent 51, 51'. The bottom end position 52 is shown in the representation of FIG. 14.

FIG. 15 shows the slide 48 in an intermediate position 53 with swung-out separating fingers 14, 14', which are held in this position by a spring (not shown here).

FIG. 16 shows the slide 48 in the top end position 54.

The mode of operation of the invention is as follows: in the example explained below for a singularizing method according to the invention, the frontmost heald in the stack can first be laterally contacted and thereby deflected in a region 11 of the heald (cf. FIG. 1) which is adjacent to the eye 8, as viewed in the longitudinal direction of the heald, and said frontmost heald is removed from the stack 5, so that the frontmost heald assumes an intermediate position in front of the stack, as can be seen, for example, from FIG. 11 for the heald 39. In this connection "laterally" indicates a direction which is horizontal and perpendicular to the supporting rails. At the same time, the eye which is adjacent to the deflected region is also displaced on its supporting rail into a similar advanced intermediate position. The heald 39 is deflected essentially in a plane 62—which is oriented approximately vertically to the supporting rails (cf. FIG. 8)—and the stack 37 is pushed back slightly. The remaining or further regions of the heald are then pushed away from the stack into the intermediate position, so that the heald 17, 18 (FIG. 1), with its entire length, now assumes an intermediate position at a first distance from the heald 15, 16, as shown in FIG. 1 for healds 17, 18.

The heald 17, 18 is then seized in the region of its eyes and transported further away from the stack by a second distance along the supporting rails until a position is reached as shown by FIG. 2 for the healds 17, 18.

The above operations are to be described in more detail below in connection with the apparatus:

The healds are lined up at their eyes on supporting rails 1, 2, 3, 4 to form stacks 5, 6. The stacks—in the transport direction of the healds—are in each case acted upon from the rear by a spring 43 (FIG. 9) and are ready for separation. First of all the separating device 9, 10 comes into action. In the separating device 9, 10, the separating blade 32 occupies the position shown in FIG. 7, the stack 37 lining up in the recess 38 at the separating blade 32. Likewise, the stack can bear against a separating finger 14 (FIG. 1), which is in its top end position 54 (FIG. 14). The separating blade 32 then begins to deflect the frontmost heald 39 in the stack laterally in its plane 62, and the stud 40 slides on the detent 41 along the stack pusher 34. Once the stud 40 has reached a more sharply inclined part of the detent 41, the stack pusher 34 presses faster towards the stack 37 and pushes the latter back by a few millimeters. While the stack pusher 34 pushes back the stack 37, the pin 45*c* (FIG. 13) of the control pin 45 runs up on the inclined part 42*a* of the detent 42, deflects inwards in the process and extends again on the other side of the perpendicular part 42*b* when the stack pusher 34 has reached the position shown in FIG. 10. The stack 37 is thus held back. This can also be seen from FIG. 9. Before the heald 39 has reached the laterally deflected position shown in FIG. 9, the separating finger 14 has also been moved into its bottom end position 52 and swung in by the detent 51 in the process. The separating blade 32 then starts its return movement. In the process, the control pin first of all catches behind the part 42*b* of the detent 42 and thus also retains the stack pusher 34 in this position, although the stud 40 no longer rests on the detent 41. As soon as the control pin 45 has reached the end of the detent 42, the stack pusher 34, under the force of a spring 46 (FIG. 10), can displace the heald 39 into the intermediate position shown in FIG. 11. If the separating finger 14 now returns into its top end position 54, it also passes through its intermediate position 53, in which the separating finger 14 is completely swung out again. In the process, the separating finger 14 engages in the region 11 behind the heald 39 and also puts those regions of the heald into the intermediate position which may still rest on the stack. Only then has the heald, with its entire length, reached the intermediate position shown in FIG. 1 for the healds 17, 18, from which intermediate position it is conveyed further by the transport members 12, 13. This now means that the heald 31, according to FIG. 5, is carried along by the rotary bodies 20, 21, which rotate towards one another, the supporting rail 2, 4 also always being guided and supported. By the rotary bodies 20, 21 rotating in the direction of the arrows 55, 56 (FIG. 6), the heald 31 is moved forward first by the driver 28 and then also by sections 57 of the supporting bodies 26, 27. In the process, first the sections 58, then the sections 57 and 58 and finally again only the sections 57 support the supporting rail 2, 4 towards the top and towards the bottom against the force of gravity. At the side, the supporting rails 2, 4 are for the most part guided by the outer periphery 63 of the driver 28 and by a body 59 between the supporting bodies 26, 27. Provided in the body 59 and in the supporting bodies 26, 27 is a recess 60 (FIG. 6) in which the eye is able to pass through. If the recess 60 is turned towards the supporting rail, the supporting rail is not guided laterally for a short time. However, the rotary bodies 20, 21 are rotated further beyond the position shown in FIG. 6 until a complete revolution has been effected and the position according to FIG. 4 has been reached again. As a result, the heald 31 is also moved further on the supporting rail by the section 57. The operations described then start again for a further heald.

In order to carry out the method, it is sufficient if a control of an apparatus according to the invention coordinates three simple movements. These are the movement of the separating blade 32, the movement of the slide 48 and the movement of the transport members 12, 13. If the separating blade 32 has completed its movement, the movement of the slide from its bottom end position into its top end position 54 follows. The transport members 12, 13 then perform a movement which comprises a rotation of 360°. The drives may also be of very simple design, since the separating blade 32 and the slide 48 perform a linear movement and the rotary bodies 20, 21 perform a rotary movement. As already apparent from FIGS. 1, 2 and 12 to 14, all the parts of the apparatus may be of twin design and arrangement in a common drive, so that two stacks 5 and 6 can also be handled at the same time. A common slide 48 is also possible for the separating fingers 14, 14'. It is likewise conceivable for the apparatus to be of only single design for a single stack.

What is claimed is:

1. Method of singularizing healds, which are lined up at eyes on supporting rails (1, 2, 3, 4) to form a stack (5, 6), the respectively frontmost heald (15, 16) in the stack is laterally deflected, the frontmost heald is then removed from the stack in a direction (19) pointing away from the stack, characterized in that the heald (15, 16) is seized at least in the region of one of its eyes (7) and transported further away from the stack along the supporting rails.

2. Method according to claim 1, characterized in that the frontmost heald (15, 16) in the stack (5, 6) is initially contacted and thereby laterally deflected only in one region (11) of the heald, the heald (5, 6) is then removed from the stack in further regions, and in that the heald is subsequently seized in the region of one of its eyes.

3. Method according to claim 1, characterized in that the heald is deflected essentially in one plane (62), and the stack is held back.

4. Method according to claim 3, characterized in that the plane (62) is oriented essentially vertically to one of the supporting rails (1, 2, 3, 4).

5. Method according to claim 1, characterized in that the heald, first of all in a region (11) adjacent to one eye and subsequently in other regions, is moved into an intermediate position in front of the stack and is then moved further from there with a plurality of regions of the heald, preferrably as a body.

6. Method according to claim 1, characterized in that the heald is seized in the region of its eyes by a transporting member, with which a supporting rail is also supported against the force of gravity.

7. Apparatus for singularizing healds from a heald stack, in particular for carrying out the method according to claim 1, which has a separating member for separating the frontmost heald and a separating finger (14) for transporting the frontmost heald, characterized by a stack pusher (34) for pushing back the stack.

8. Apparatus according to claim 7, characterized in that the separating member is designed as a separating blade (32) for separating the frontmost heald of a stack.

9. Apparatus according to claims 7 and 8, characterized in that a transport member (12, 13) is provided in the region of the eyes of the healds.

10. Apparatus according to claim 9, characterized in that the transport member includes means for supporting the supporting rail against the force of gravity and for laterally guiding the supporting rail.

11. Apparatus according to claims 9 and 10, characterized in that the transport member has two rotary bodies (20, 21), between which a supporting rail (1, 2, 3, 4) is passed through.

12. Apparatus according to claims 7 to 11, characterized in that the stack pusher (34) is rotatably mounted about a pivot (35) and has a detent (41) for moving by the separating member.

13. Apparatus according to claims 11 and 12, characterized in that the stack pusher has a lug (44) for advancing the heald (39).

14. Apparatus according to claims 1 to 13, characterized in that the stack pusher has a control pin (45) and the separating blade has a detent (42) for the control pin.

15. Apparatus according to claim 14, characterized in that the detent (42) includes means for retaining the stack in position during the return movement of the separating blade.

* * * * *

UNITED STATES PATENT AND TRADEMARK OFFICE

CERTIFICATE OF CORRECTION

PATENT NO. : 6,230,377 B1
DATED : May 15, 2001
INVENTOR(S) : Daniel Tanno

It is certified that error appears in the above-identified patent and that said Letters Patent is hereby corrected as shown below:

Title page,
Item [86], § 371 Date and § 102 (e) Date, the date should read: -- June 15, 2000 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*